US008548631B1

(12) United States Patent
Rossi et al.

(10) Patent No.: US 8,548,631 B1
(45) **Date of Patent: *Oct. 1, 2013**

(54) METHOD AND SYSTEM FOR COOPERATIVE POWERING OF UNITARY AIR CONDITIONERS

(75) Inventors: John Rossi, Duluth, GA (US); Wendell Miyaji, Duluth, GA (US)

(73) Assignee: Comverge, Inc., Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/543,857

(22) Filed: Jul. 8, 2012

Related U.S. Application Data

(63) Continuation of application No. 12/492,211, filed on Jun. 26, 2009, now Pat. No. 8,239,068.

(51) Int. Cl.
*G05D 23/00* (2006.01)

(52) U.S. Cl.
USPC ..... 700/277; 700/295

(58) Field of Classification Search
USPC ..... 700/276, 277, 295
See application file for complete search history.

(56) References Cited

U.S. PATENT DOCUMENTS

| | | | | |
|---|---|---|---|---|
| 3,352,352 | A | 11/1967 | Walters | |
| 4,187,543 | A | 2/1980 | Healey | |
| 4,663,748 | A * | 5/1987 | Karbowiak et al. | 370/224 |
| 4,766,530 | A * | 8/1988 | Roslund | 709/225 |
| 4,773,587 | A | 9/1988 | Lipman | |
| 4,784,212 | A | 11/1988 | Brimer | |
| 4,909,585 | A * | 3/1990 | Kobayashi et al. | 398/141 |
| 5,001,472 | A * | 3/1991 | Fischer et al. | 370/455 |
| 5,058,388 | A | 10/1991 | Shaw | |
| 5,372,015 | A | 12/1994 | Suzuki et al. | |
| 5,642,270 | A | 6/1997 | Green et al. | |
| 5,684,463 | A | 11/1997 | Diercks et al. | |
| 5,918,668 | A | 7/1999 | Trimble | |
| 6,427,454 | B1 | 8/2002 | West | |
| 6,622,925 | B2 * | 9/2003 | Carner et al. | 236/46 R |
| 6,681,154 | B2 | 1/2004 | Nierlich et al. | |
| 6,724,100 | B1 | 4/2004 | Gabriel | |
| 6,823,291 | B2 | 11/2004 | Marsland | |
| 7,076,961 | B2 * | 7/2006 | Takusagawa | 62/157 |
| 7,373,222 | B1 * | 5/2008 | Wright et al. | 700/295 |
| 7,379,997 | B2 | 5/2008 | Ehlers et al. | |
| 7,402,978 | B2 | 7/2008 | Pryor | |

(Continued)

FOREIGN PATENT DOCUMENTS

| | | |
|---|---|---|
| EP | 2042816 A1 | 4/2009 |
| WO | 2008/036878 | 3/2008 |
| WO | 2008029201 | 3/2008 |
| WO | 2008064179 | 5/2008 |

*Primary Examiner* — Ryan Jarrett
(74) *Attorney, Agent, or Firm* — Smith Risley; Steven P. Wigmore

(57) ABSTRACT

A method and system provide for the cooperative powering of unitary air conditioners. The method and system includes coordinating powering of unitary air conditioners in a multi-unit building or other low level of aggregation in a power grid. Multiple unitary air conditioners can use a power line communication (PLC) communication module for communicating with other air conditioners that are within the same multiunit building. According to one aspect of the method and system, by using power line communications, multiple unitary air conditioners within a single building can form self-contained local area networks. The LAN can also support a token ring network. According to this token ring network, a predetermined number of tokens can be assigned within the token ring network.

20 Claims, 7 Drawing Sheets

(56) References Cited

U.S. PATENT DOCUMENTS

| | | | | |
|---|---|---|---|---|
| 7,869,363 | B2 * | 1/2011 | Shamilian et al. | 370/235 |
| 8,239,068 | B1 * | 8/2012 | Rossi et al. | 700/277 |
| 2003/0041161 | A1 * | 2/2003 | Billings et al. | 709/231 |
| 2003/0093332 | A1 | 5/2003 | Spool et al. | |
| 2004/0059815 | A1 | 3/2004 | Buckingham et al. | |
| 2004/0138981 | A1 | 7/2004 | Ehlers | |
| 2004/0139038 | A1 | 7/2004 | Ehlers | |
| 2006/0086112 | A1 | 4/2006 | Higgins | |
| 2006/0105697 | A1 | 5/2006 | Aronstam et al. | |
| 2006/0152189 | A1 | 7/2006 | Ambrosio et al. | |
| 2006/0186214 | A1 | 8/2006 | Simon | |
| 2006/0219448 | A1 | 10/2006 | Grieve et al. | |
| 2006/0250902 | A1 | 11/2006 | Bender et al. | |
| 2007/0129850 | A1 | 6/2007 | Miyaji | |
| 2007/0132579 | A1 | 6/2007 | Kim | |
| 2007/0178823 | A1 | 8/2007 | Fincher | |
| 2007/0178825 | A1 | 8/2007 | Knobloch | |
| 2008/0007202 | A1 | 1/2008 | Pryor | |
| 2008/0017723 | A1 | 1/2008 | Johnson et al. | |
| 2008/0040296 | A1 | 2/2008 | Bridges et al. | |
| 2008/0048046 | A1 | 2/2008 | Wagner et al. | |
| 2008/0135635 | A1 * | 6/2008 | Deng et al. | 236/44 C |
| 2008/0283621 | A1 | 11/2008 | Buckingham et al. | |
| 2011/0109266 | A1 * | 5/2011 | Rossi | 320/109 |

* cited by examiner

METHOD AND SYSTEM FOR COOPERATIVE POWERING OF UNITARY AIR CONDITIONERS

PRIORITY AND RELATED APPLICATIONS STATEMENT

This application claims priority under 35 U.S.C. §120 and is a continuation of U.S. patent application Ser. No. 12/492,211, filed on Jun. 26, 2009 now U.S. Pat. No. 8,239,068 and entitled, "METHOD AND SYSTEM FOR COOPERATIVE POWERING OF UNITARY AIR CONDITIONERS," the entire contents of which are hereby incorporated by reference.

FIELD OF INVENTION

The invention is generally directed to unitary or "room" air conditioners. The technology relates more particularly to cooperative powering of unitary air conditioners.

BACKGROUND OF THE INVENTION

Unitary air conditioners, also known as room air conditioners, have all of the components of a central air conditioning system but all of the components are contained within a single housing. This means that the condenser, evaporator, expansion valve, compressor, exterior fan, and interior fan are generally contained within a single housing.

Unitary air conditioners are often used in buildings where there are multiple individual living spaces, such as in apartment buildings and office buildings. Within each living space, an occupant may have individual control over each respective unitary air conditioner that is supplied to cool a particular living space. In warm weather months or in warm weather climates, multiple unitary air conditioners operating at the same time or in unison can create tremendous loads on electric power grids. Also, the building electrical bill may depend on the peak amount of energy used in any one interval (often 15 or 30 minutes) in a billing period as well as on the total energy used in the billing period. This peak interval usage is referred to as a demand charge. Multiple air conditioners on at the same time can cause a demand peak for the building.

In addition to the problems caused by multiple unitary air conditioners operating at the same time within multiunit buildings, it is understood that each living space within a multiunit building may have a unique cooling load. In other words, each living space may require a different level of energy to cool the living space to a temperature desired by an occupant. For example, a south facing side living space which receives a significant amount of sunlight during daylight hours will generally need more energy to cool its living space compared to a north facing side living space which is generally in the shade caused by the shadow of the building during daylight hours.

Accordingly, there is a need in the art for a method and system for the cooperative powering of unitary air conditioners which takes into account the unique cooling loads of different living spaces caused by the position of each living space relative to sunlight it may receive or other external environmental elements which may impact a cooling load on a given living space. There is a further need in the art for a method and system for cooperative powering of unitary air conditioners in order to reduce the load or strain on an electric power grid, while also allowing each unitary air conditioner to achieve a temperature of a living space desired by an occupant.

SUMMARY OF THE INVENTION

A method and system provide for the cooperative powering of unitary air conditioners. The method and system includes coordinating powering of unitary air conditioners in a multiunit building or other low level of aggregation in a power grid.

Multiple unitary air conditioners can use a power line communication (PLC) communication module for communicating with other air conditioners that are within the same multiunit building. According to one aspect of the method and system, by using power line communications, multiple unitary air conditioners within a single building can form self-contained local area networks.

According to the method and system, after the unitary air conditioners are coupled to one another through power line communications, they can form a communication network, such as a local area network (LAN). The LAN can also support a token ring network. According to this token ring network, a predetermined number of tokens can be assigned within the token ring network. In one exemplary embodiment, one token may be assigned to a single unitary air conditioner out of a group of unitary air conditioners which are part of the token ring network. But more than one token may be provided, such as a plurality of tokens within a given token ring network, and is within the scope of the invention.

Only unitary air conditioners with a token may receive energy or be permitted to turn "on." In this way, a power grid servicing a multiunit building is reduced. In this way, overloading and possible failure of a power grid may be avoided and peak billing demand may be reduced.

Alternatively, the token passing system could be used to implement a token that acts in the opposite sense, that is, if a unit receives a token, it turns off and then follows a preset procedure to determine when to pass on the token. After passing the token, the unit would then be enabled to turn on. This alternate arrangement would be more efficient in a situation where the majority of air conditioners would be allowed to run. Hence, fewer tokens would be required.

During formation of a token ring network, a list can be generated to enumerate the unitary air conditioners who are part of the network. This list can be stored in each air conditioner's memory. Next, the first token or first set of tokens can be assigned to one or more unitary air conditioners within the network. The assignment of the first token or tokens can be made according to predetermined criteria. For example, such predetermined criteria can include an assessment of the permanent serial numbers that may be assigned to each unitary air conditioner. A unitary air conditioner with the highest or lowest serial number may be assigned to the first token. Other criteria beyond serial identification numbers of unitary air conditioners for assigning the first token or first set of tokens is within the scope of the invention.

The unitary air conditioner assigned with the first token then can determine the priority of the token distribution within the token ring network. The unitary air conditioner assigned with the token can assess many variables associated with cooling a multiunit building in order to determine the order in which unitary air conditioners should receive the token. For example, variables such as desired temperatures of a living space, and the amount of time available compared to the amount of power needed to cool each living space to a desired temperature can be assessed.

Once the unitary air conditioner with the first token determines the priority or order in which the token should be passed from one unitary air conditioner to the next, the token is passed to the unitary air conditioner with the highest priority. Next, the unitary air conditioner with the token is able to start cooling its assigned living space. While the unitary air conditioner with the token is cooling its assigned living space, the unitary air conditioner can also monitor the status of the other unitary air conditioners who are members of the token ring network. The unitary air conditioner assigned with the token can also monitor other variables in the token ring network.

For example, other variables which can be monitored by the unitary air conditioner assigned with the token ring can include, but are not limited to, monitoring the time of day; determining if there is enough time to cool remaining living spaces within the time allotted by each living space occupant; checking to see if other new unitary air conditioners have entered into the local network; and determining if there have been updates by occupants for desired temperatures of a living space.

According to another exemplary aspect, a method and system assigns living spaces of a multiunit building to predetermined groups. Each predetermined group may include living spaces that have similar cooling loads, such as those living spaces which are directly impacted by sunlight or shade. With these groupings, the living spaces can be cooled by taking into account the extra energy or power that may be needed by some higher cooling load living spaces relative to other lower cooling load living spaces which have a reduced cooling load due to environmental factors such as shade.

DETAILED DESCRIPTION OF EXEMPLARY EMBODIMENTS

Figure 1:
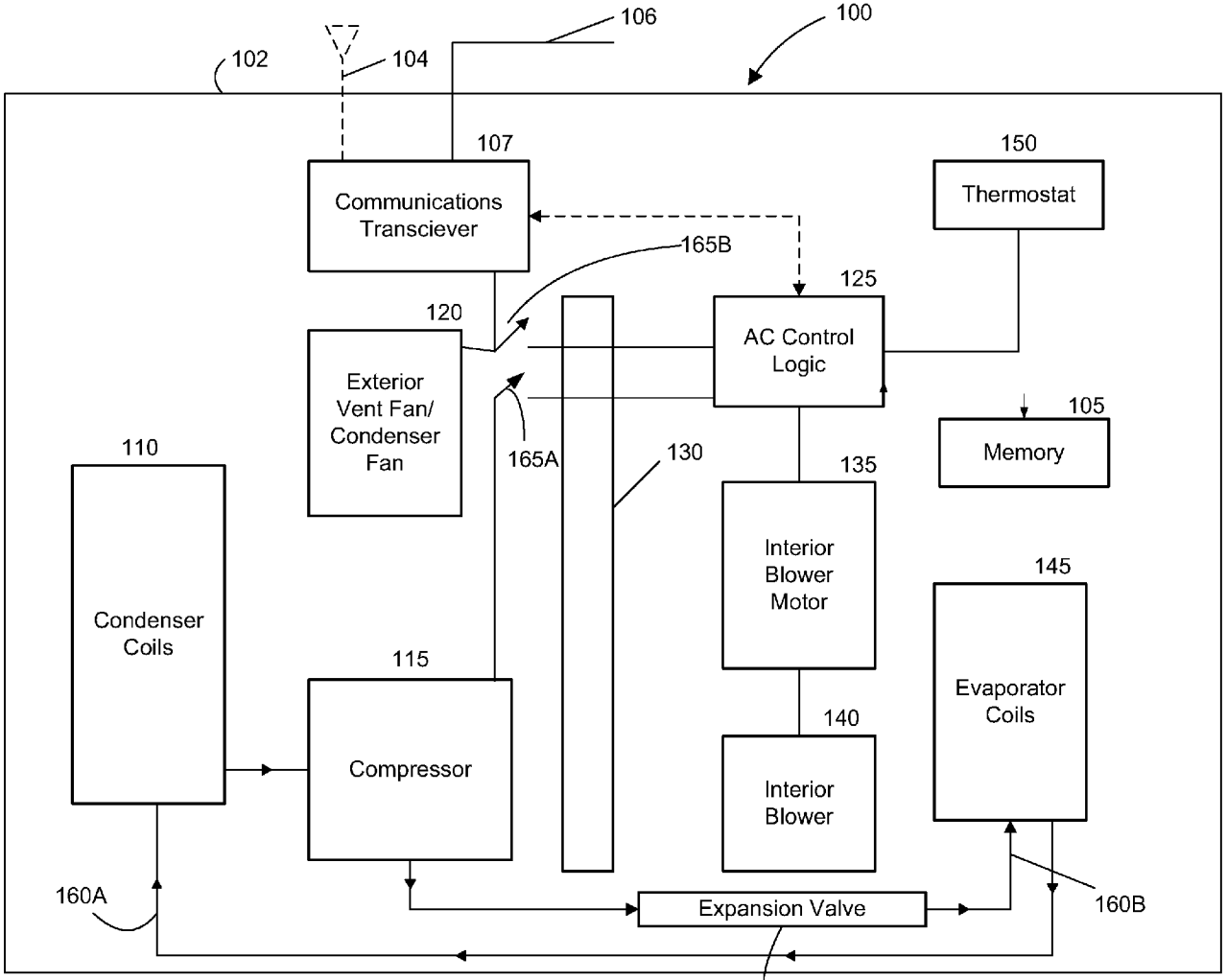
FIG. 1 is a functional block diagram of a unitary air conditioner according to one exemplary embodiment of the invention.

Turning now to the drawings, in which like reference numerals refer to like elements, FIG. 1 is a functional block diagram of a unitary air conditioner 100 according to one exemplary embodiment of the invention. The unitary air conditioner 100 can comprise a housing 102 that contains a communications transceiver 107 coupled to a relays or switches 165A, 165B. The relays or switches 165 may control power to a compressor 115 and the exterior vent fan/condenser fan 120.

The communications transceiver 107 may comprise a packet radio in which the transceiver 107 is coupled to an antenna 104. The communications transceiver 107 can support wireless communications protocols, such as the Zigbee wireless communication protocol. For the Zigbee wireless communication protocol, the transceiver 107 may comprise a low-powered digital radio which employs the IEEE802.15.4-2006 standard for wireless personal area networks. However, other communication protocols and standards for radio frequency communications are not beyond the scope of the invention. For example, other communication protocols can include, but are not limited to IEEE802.11, Bluetooth IEEE802.16 (wireless LAN), WAN, and other like wireless communication protocols. The section below describes how a token ring network is formed in a power line communication (PLC) environment. A technique similar to the PLC embodiment can be employed in an RF environment where the range limitations of the wireless technology is exploited to limit the potential participants in the token ring network. This is similar to how the PLC embodiment uses the natural attenuation properties of a wired network to limit its participants, Specifically, in a wired embodiment, the transceiver 107 could also support power line communications (PLCs). PLCs referred to in this description include systems for carrying data on conductors 106 that may also be used for electric power transmission. Electrical power is typically transmitted over high voltage transmission lines, distributed over medium voltage, and used inside buildings at lower voltages. It is well understood to one of ordinary skill in the art that power line communications can be applied at each stage.

Many PLC technologies may limit themselves to one set of wires such as in the case of wires within a single structure, but some PLC can cross between two levels. For examples, some PLC can cross between a distribution network and premises wiring. The power line communications systems used herein may operate by impressing a modulated carrier signal on the wiring system 106. Different types of power line communications can use different frequency bands, depending on the signal transmission characteristics of the power wiring used.

Since many power wiring systems are usually intended for only transmission of alternating current power, many power wire circuits usually have a limited ability to carry higher frequencies. This propagation problem can be a limiting factor for power line communications, however, this propagation problem is used advantageously by the unitary air conditioners 100 described herein.

Because of the attenuation of power line communications over relatively short distances, unitary air conditioners 100 of the same multi-unit building that are being serviced by the same, local distribution transformer 218 can form self-contain local area networks due to the propagation problem noted above. This means that the strength of the signals for power line communications are such that usually only air conditioners 100 coupled to a distribution transformer can communicate with one another. Air conditioners 100 coupled to a first transformer will likely not be able to detect or communicate with other air conditioners which are coupled to a second transformer due to the losses of RF power in the communication signals when they are propagated over power lines 106 for significant distances and through two or more transformers 218.

Specifically, there is typically high frequency loss through the transformer. And usually, a signal from a first multiunit dwelling to a second multiunit dwelling would typically pass through two distribution transformers. Also, in a network distribution system where feeder transformer secondary windings are interconnected, the high frequency loss due to propagation distance and the increased noise due to the large number of loads on the network will tend to limit the propagation distance of the PLC.

The power line communication (PLC) systems can include Home Plug 1.0 which is a specification for home networking technology that couples devices to each other through power lines 106 in a building. Home Plug certified products may couple personal computers and other devices such as air conditioners 100 that may also use other communication standards such as Ethernet, USB (Universal Serial Bus) and wireless local area network communications such as IEEE 802.11. Many devices may have the Home Plug standard built in such as the air conditioners 100 illustrated in FIG. 1. With the Home Plug standard built-in into an air conditioner 100, to connect the air conditioner 100 to a network, all that is required is to plug the air conditioner 100 into an outlet of a wall in a home such that it may communicate with other devices that support the Home Plug standard.

Since the power line communication signals may travel a short distance outside of a home to a distribution transformer 218, like many other network standards, the Home Plug power line communication standard includes the ability to set an encryption password. As with many other networking products, most Home Plug devices are secured by default in which the standard may require that all devices supporting the standard are set to a default out-of-box password, which may be a common one. Users of the devices are encouraged to change this password for obvious reasons.

Devices which support the Home Plug power line communication standard may function as transparent network bridges which may allow computers running on any operating system to use them for network access. The Home Plug communication standard supports the ability to use Ethernet in a bus topology in which it has carrier sense, multiple access and collision detection.

This is achieved by the use of advanced orthogonal frequency division multiplexing (OFDM) that allows co-existence of several distinct data carriers along the same power-supplying wire. Use of OFDM allows turning off (masking) one or more of the subcarriers which overlap previously-allocated radio spectrum in a given geographical region. In North America, some Home Plug standards may only use 917 of an available 1,155 subcarriers.

In addition to receiving control signals, the communications transceiver 107 can communicate status signals or relay control signals (such as the token 502) described below. In this way, a central controller (not illustrated) separate from the air conditioners 100 can monitor the status and control many different air conditioners 100.

Referring back again to FIG. 1, the switches or relays 165 of the unitary air conditioner 100 can comprise an electromagnetic relay (not illustrated). The relays 165 may comprise a coil of wire surrounding a soft iron core or an iron yoke, which provides a low reluctance path for magnetic flux, a moveable iron armature, and a set, or sets, of contacts. The armature may be hinged to the yoke and mechanically linked to a moving contact or contacts. It may be held in place by a spring so that when the relay is de-energized there is an air gap in the magnetic circuit. The relays 165 may have more or fewer sets of contacts depending on their function. The relays 165 may also have a wire connecting the armature to the yoke. This may ensure continuity of the circuit between the moving contacts on the armature, and the circuit track on a Printed Circuit Board (PCB) via the yoke, which may be coupled to a PCB, such as by a soldering.

When an electric current is passed through the coil of a relay 165, the resulting magnetic field attracts the armature and the consequent movement of the movable contact or contacts either makes or breaks a connection with a fixed contact. If the set of contacts was closed when the relay 165 was de-energized, then the movement opens the contacts and breaks the connection, and vice versa if the contacts were open. When the current to the coil is switched off, the armature is returned by a force, approximately half as strong as the magnetic force, to its relaxed position. Usually this force is provided by a spring, but gravity may also be used.

Most relays 165 are manufactured to operate quickly. In a low voltage application, this speed may help to reduce noise. In a high voltage or high current application, this is to reduce arcing. The switches or relays 165 of the inventive system 100 may include, but is not limited to, those of a latching type, a reed type, a mercury-wetted type, a polarized type, a contactor type, a solid-state type, a solid-state contactor type, a buchholz type, and a forced-guided contacts type.

The relays 165 may be interposed between the compressor 115 and the NC control logic 125, and between the exterior vent fan/condenser fan 120 and NC control logic 125. The A/C control logic 125 can comprise any one of a combination of programmable circuitry. For example, the NC control logic 125 can comprise firmware in combination with a microcontroller, a microprocessor, a digital signal processor, or a state machine implemented in an application specific integrated circuit (ASIC), programmable logic, or other numerous forms of hardware and/or software without departing from the scope of the invention. The NC control logic 125 can be coupled to a memory device 105 and a thermostat 150.

The memory device 105 can comprise volatile or non-volatile memory. If the memory device 105 comprises volatile memory it can comprise RAM. If the memory device 105 comprises non-volatile memory, it can comprise ROMs or EEPROMS. Other hardware configurations for the memory device 105 are not beyond this scope of the invention.

The NC control logic 125 an also be coupled to an interior blower motor 135 which is coupled to an interior blower 140. The A/C control logic 125 can also be coupled an exterior vent fan 120 which may blow outside or external air over the condenser coils 110. Meanwhile, the interior blower or fan 140 is designed to recirculate air taken from the living space over the evaporator coils 145.

The evaporator coils 145 are coupled to an expansion valve 155 and condenser coils 110 through conduits 160A, 160B. The condenser coils 110 are coupled to the compressor 115 through another conduit. The compressor 115 is also coupled to the expansion valve 155 via conduit 160B.

As understood to one of ordinary skill in the art, during operation of the air conditioner 100, the compressor 115 compresses a refrigerant while it is in a liquid state. The refrigerant can comprise any one of hydrochlorofluorocarbons (HCFCs) and hydrofluorocarbons (HFCs) such as R-11, R-12, R-22, R-134A, and R-410A. The pressure on the refrigerant is allowed to drop when it passes through the expansion valve 155.

The refrigerant in a liquid state and at low pressure absorbs any heat from the living space and is transformed to vapor as it passes through the evaporator coils 145. The compressor 115 forces the vapor through the condenser coils 110 at which the vapor condenses to a liquid while also releasing the energy or heat that was absorbed at the evaporator stage of the cycle. The refrigerant then continues again through the compressor 115.

Within the housing 102, the exterior vent fan/condenser fan 120, the condenser coils 110, and compressor 115 can be separated from the interior blower motor 135, interior blower 140, and evaporator coils by an barrier or wall 130. The communications receiver 107, A/C control logic 125, thermostat 150, and memory 105 can be placed on either side of the barrier or wall 130. It is noted that the condenser fan 120 and the interior blower 140 can share a common motor such as motor 135. In this case, the motor 135 will drive both units when it is on. Since the vast majority of the energy in a room air conditioner 100 is used by the compressor 115, the control of this common motor 135 is not a major concern in reducing power consumption.

With the inventive air conditioner 100, a communications signal may be received by the communications transceiver 107 to activate the relays 165A, 165B which control power to the exterior vent fan/condenser fan 120 and the compressor 115. Meanwhile, the A/C control logic 125 can still allow power to be supplied to the interior blower motor 135 and the interior blower 140. In this way, a substantial reduction in energy being consumed by the unitary air conditioner 100 while allowing the interior air to circulate, thus improving comfort compared to turning off the entire unitary air conditioner 100.

According to an alternate exemplary embodiment, the compressor 115 and exterior vent fan/condenser fan 120 may not be controlled directly by the communications transceiver 107. Instead, the communications transceiver 107 may be coupled directly to the NC control logic 125 as indicated with a dashed line. The NC control logic 125 could then control the relays 165 to turn power on and off for the fan 120 and compressor 115.

Figure 2A:
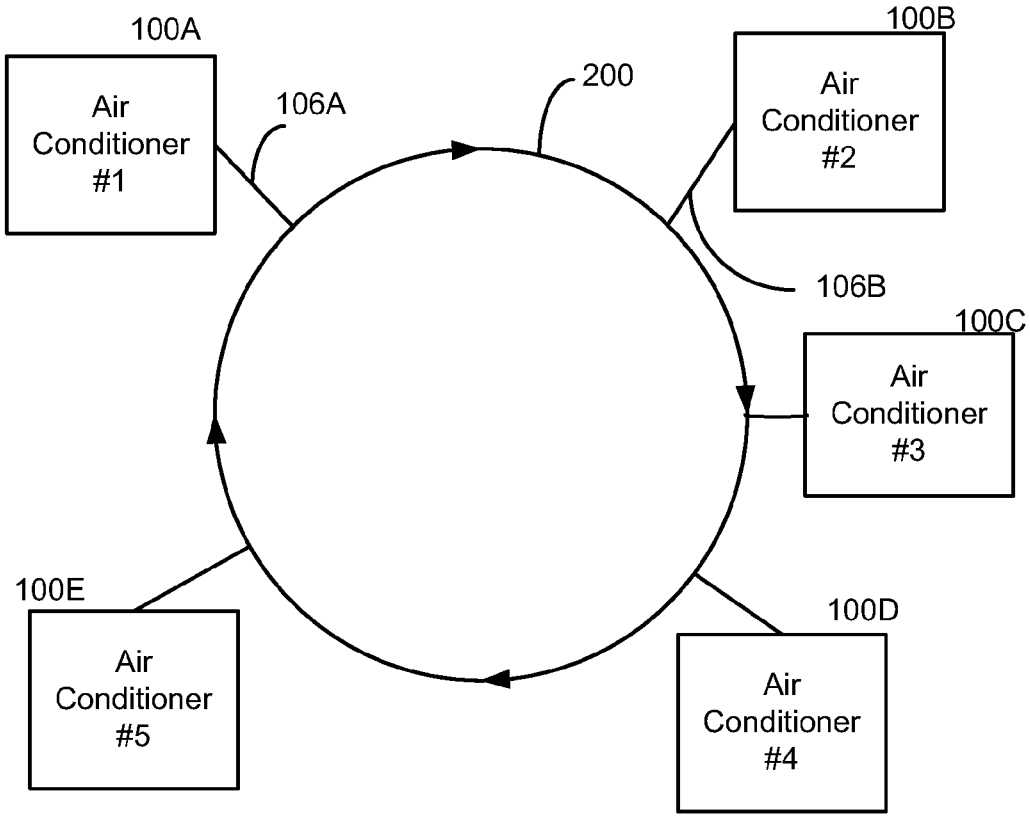
FIG. 2A is a functional block diagram illustrating an exemplary token ring network formed by unitary air conditioners of a multiunit building according to one exemplary embodiment of the invention.

Referring now to FIG. 2A, this figure is a functional block diagram illustrating an exemplary token ring network 200 formed by unitary air conditioners 100 of the various living spaces 402 (See FIG. 4) of a multiunit dwelling 400 (See FIG. 4) according to one exemplary embodiment of the invention. The token ring network 200 can be employed such that each unitary air conditioner 100 is brought online at different times relative to another unitary air conditioner 100. The logical token ring network 200 illustrates how a token from a first unitary air conditioner 100A can be passed along the logical token ring 200 to the next air conditioner 100B which could be the second air conditioner 100B so that the second air conditioner 100B comes online and establishes electrical connection along power line 106 when the second air conditioner 100B has the token. The exemplary logical token ring 200 indicates how a token can be passed along the logic suggested by this figure. However, as will be described below, the token can be passed between respective air conditioners 100 based on priority which may cause the token to skip over one or more air conditioners 100 that form the logical ring 200.

That is, for example, after the first unitary air conditioner 100A has finished its cooling cycle to a desired temperature, the token maybe passed to the next prioritized unitary air conditioner 100B which is a member of the logical token ring 200. So this means, if a third unitary air conditioner 100C has a higher priority relative to a second unitary air conditioner 100B, then the third unitary air conditioner 100C would receive the next available token before the second unitary air conditioner 100B would receive a token.

Figure 2B:
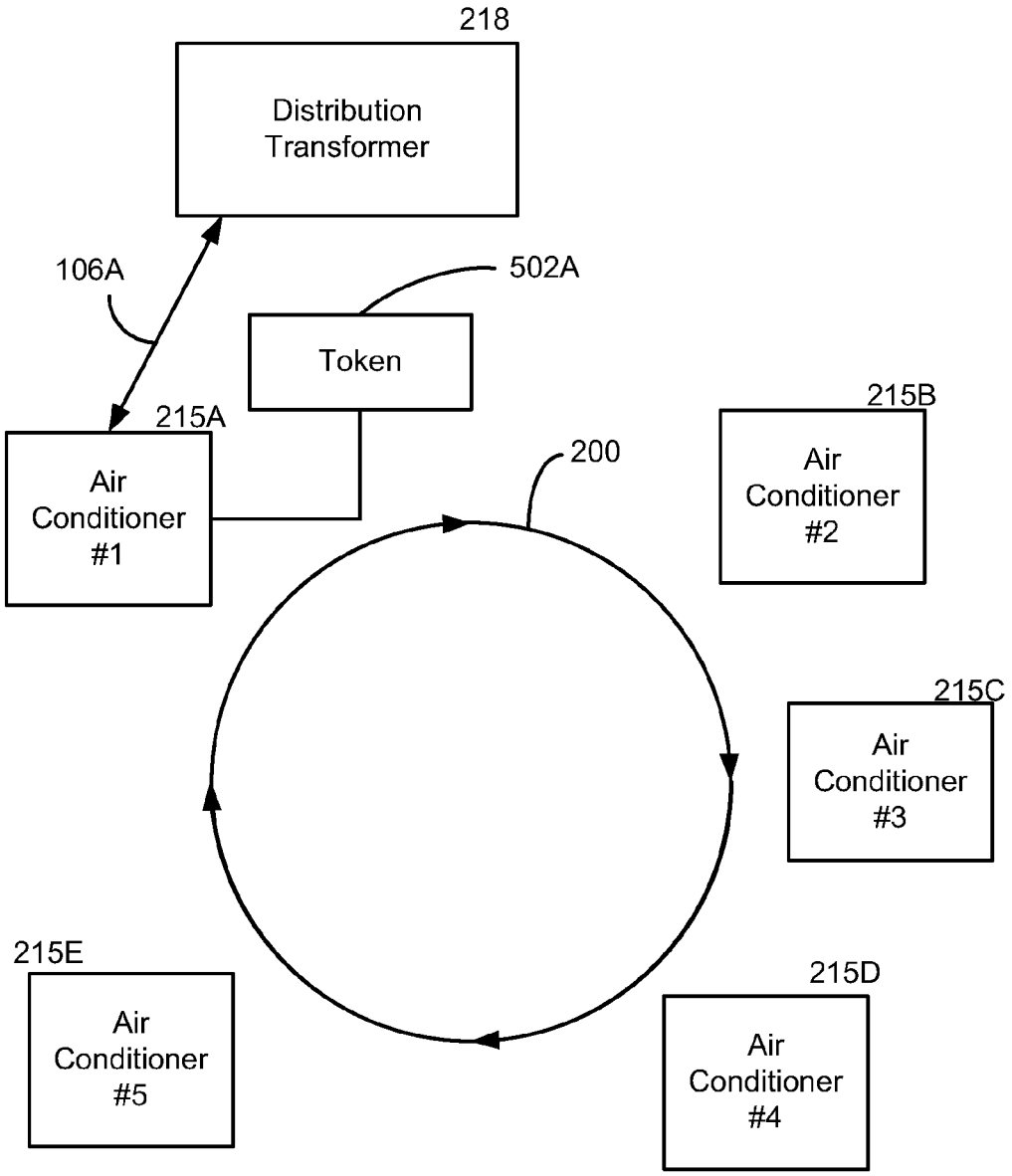
FIG. 2B is a functional block diagram illustrating an exemplary token ring network in which a first token has been assigned to a unitary air conditioner according to one exemplary embodiment of the invention.

Referring now to FIG. 2B, this figure illustrates an exemplary token ring network in which a first token 502A has been assigned to a first unitary air conditioner 100A according to one exemplary embodiment of the invention. The token 502A illustrated in FIG. 2B indicates a first unitary air conditioner 100A can establish an electrical connection with the distribution transformer 218 along a power line 106A. The remaining air conditioners 100B-100E have been illustrated without power lines 106B-E to signify that these air conditioners 100 have not established an electrical connection between themselves and the distribution transformer 218. The token 502A can simply be flag in a list stored in memory 105 or in a central location apart from the air conditioners 100 which may enumerate a token order or rank in a list of air conditioners 100 that maybe part of a particular token ring system or network to the 400. Further details of the token 502A will be described below with respect to the flow charts of FIG. 3.

Figure 2C:
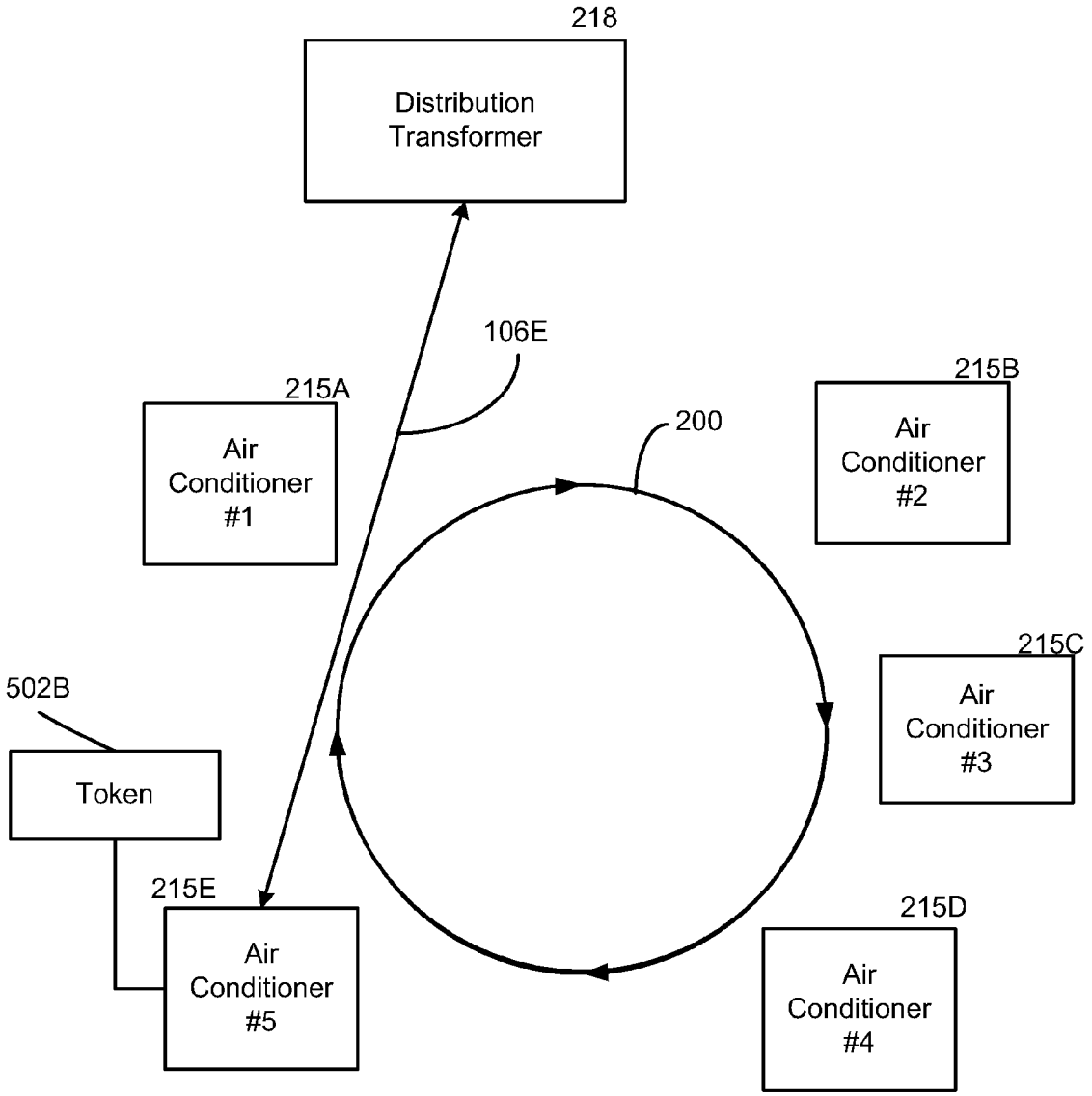
FIG. 2C is a functional block diagram illustrating the second token assigned to a second unitary air conditioner of a token ring network according to one exemplary embodiment of the invention.
Figure 5:
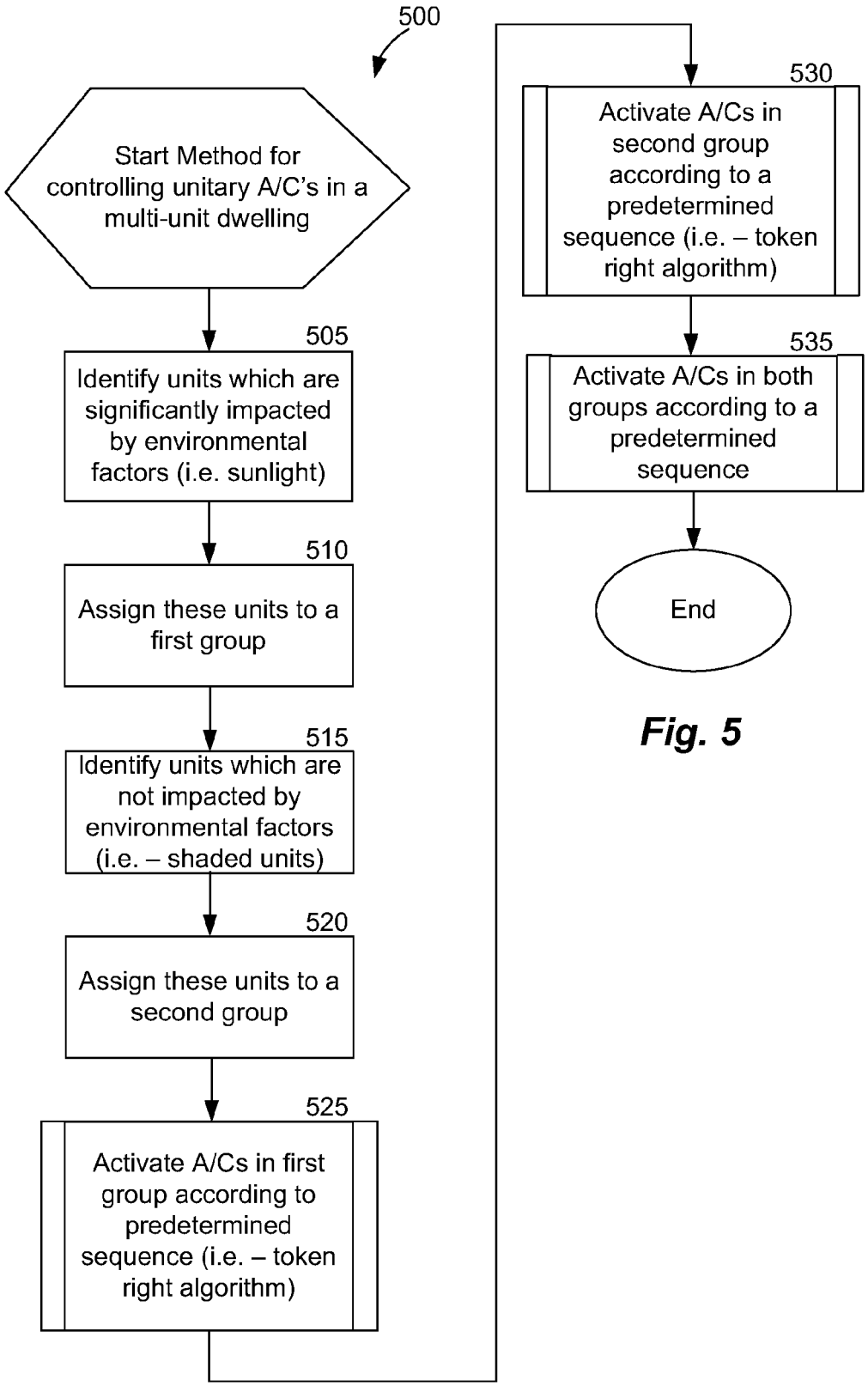
FIG. 5 is a logic flow diagram illustrating an exemplary method for controlling unitary air conditioners in a multiunit building by assigning each unitary air conditioner to predetermined groups based on environmental factors which may impact cooling loads according to one exemplary embodiment of the invention.

Referring now to FIG. 2C, this figure illustrates a second token 502B assigned to another unitary air conditioner 100E of a token ring network according to one exemplary embodiment of the invention. FIG. 2C also illustrates that the first token 502A illustrated in FIG. 5 is no longer present. Alternatively, this conceptual diagram of FIG. 2C illustrates that the first token 502A may have been passed to the fifth unitary air conditioner 100E based on priority. Since the fifth unitary air conditioner 100E has the token 502B, the fifth unitary air conditioner 100E can establish an electrical connection between the distribution transformer 218 and itself along the power line 106E. The fifth unitary air conditioner 100E may draw power from the distribution transformer 218. One of ordinary skill in the art will recognize that the invention is not limited to a single token distribution and any number of tokens 502 can be distributed along the logical token ring 400 as long as the amount of tokens 502 which allow unitary air conditioners 100 to couple themselves to the distribution transformer 218 do not cause excessive loads for the distribution transformer 218.

As noted above, in an alternative exemplary embodiment, the token passing system could be used to implement a token 502 that acts in the opposite sense, that is, if a unit 100 receives a token 502, the air conditioner unit 100 is turned off and then follows a preset procedure to determine when to pass on the token 502 to the next unit 100. After passing the token, the unitary air conditioner 100 would then be enabled to turn on. This alternate arrangement would be more efficient in a situation where the majority of air conditioners 100 would be allowed to run. Hence, fewer tokens 502 would be required.

Figure 3:
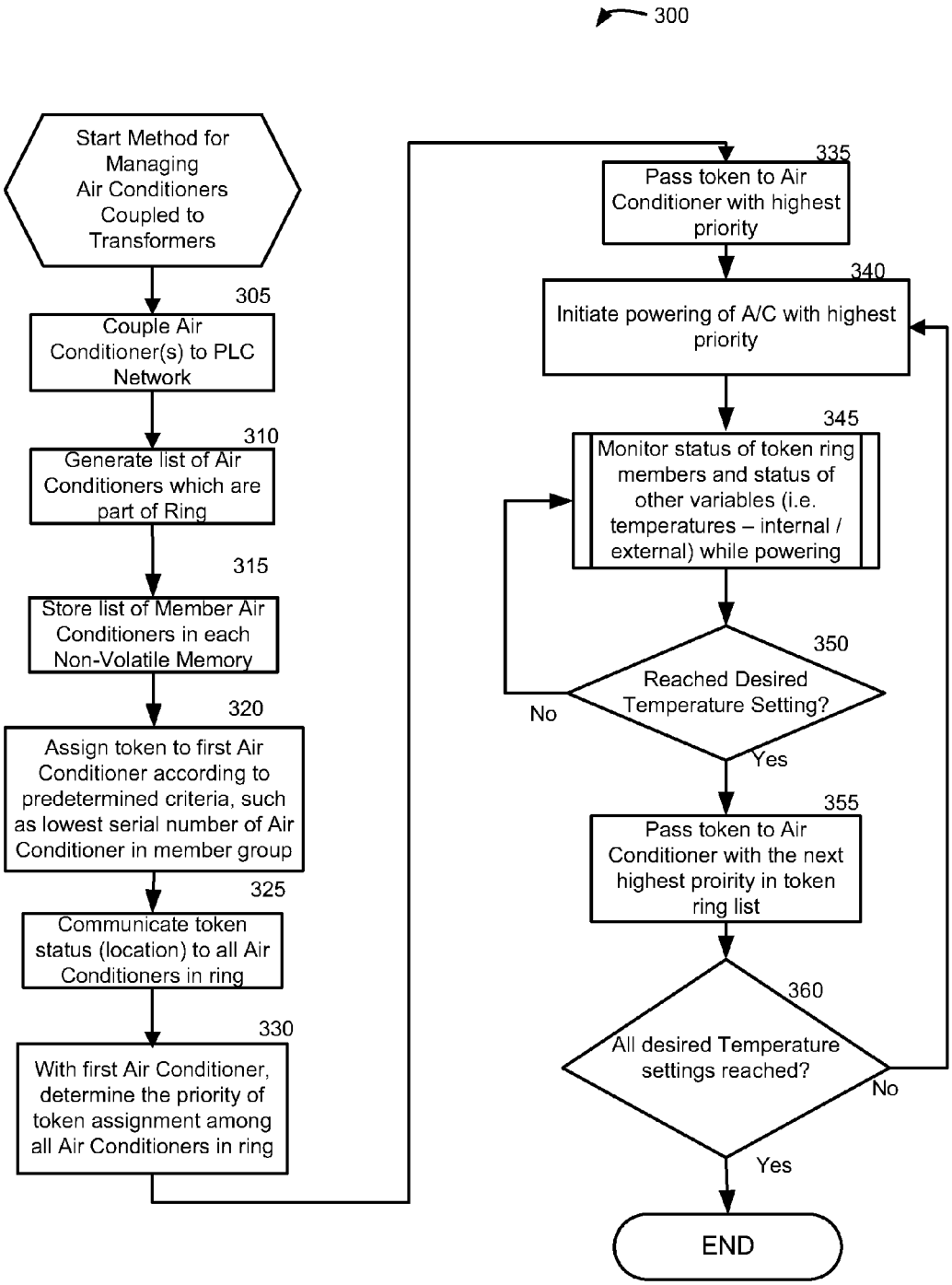
FIG. 3 is a logic flow diagram illustrating an exemplary method for managing unitary air conditioners of a multiunit building according to one exemplary embodiment of the invention.

Referring now to FIG. 3, this figures illustrates a logic flow diagram 300 of a method for managing air conditioners 100 coupled to a distribution transformer 218. Logic flow diagram 300 highlights some key functional features of the unitary air conditioners 100 as illustrated in FIG. 1. As noted above, one of ordinary skill in the art will appreciate that the process functions of the unitary air conditioner 100 may comprise firmware code executing on a microcontroller, microprocessor, a DSP, or state machines implemented in application specific integrated circuits, or programmable logic, or other numerous forms without departing from the spirit and scope of the invention.

In other words, these steps illustrated in FIG. 3 and other logic flow diagrams of this disclosure may be provided as a computer program which may include a machine-readable medium having stored there on instructions which maybe used to program a computer (or other electronic devises) to perform a process according to the invention. The machine-readable medium may include, but is not limited, optical disk, CD-ROM, magneto-optical disks, ROMs, RAMs, EEPROMs, EEPROMs, magneto-optical cards, flash memory, or other type of medias/machine-readable mediums suitable for storing electronic instructions.

Certain steps in the processes or process flow described in all of the logic flow diagrams refer to in this specification must naturally precede others for the invention to function as described. However, the invention is not limited to the order of the steps described if such order or sequence does not alter the functionality of the present invention. That is, it is recognized that some steps may perform before, after, or parallel other steps without departing from the scope and spirit of the invention. Further, one of ordinary skill and programming would be able to write such a computer program or identify appropriate hardware at circuits to implement the disclosed invention without difficulty based on the flow charts and associated description in the application text, for example.

Therefore, disclosure of a particular set of program code instructions or detailed hardware devices is not considered necessary for an adequate understanding of how to make and use the invention. The inventive functionality of the claimed computer implemented processes would be explained in more detail in the following description and in conjunction with the remaining figures illustrating other process flows.

Step 305 is the first step of the process 300 in which one or more unitary air conditioners may be coupled to a power line communications network that can comprise power lines 106 as illustrated in FIG. 2A. Next, in Step 310, each control logic 125 of an unitary air conditioner 100 can store a list of the air conditioners 100 in its memory 105. This list identifies the air conditioners 100 which are part of the logical token ring 200 as illustrated in FIG. 2A. Alternatively, this list can be stored in a central location, by a central controller (not illustrated) apart from all the air conditioners 100.

In Step 320, the assignment of the first token or group of tokens can be made according to predetermined criteria. For example, such predetermined criteria can include an assessment of the permanent serial numbers that maybe assigned to each unitary air conditioner 100. An unitary air conditioner 100 with the highest or lowest serial number may be provided with the first token 502. Other criteria beyond serial identification of the air conditioners 100 for assigning the first token or first set of tokens is within the scope of the invention. For example, token priority could be weighted by external environmental factors, like sunlight.

This calculation of token priority based on external environmental factors, like sunlight, can occur when the unitary air conditioners 100 are built or the identification can occur when each unit 100 downloads information from its respective computer network when installed in a room or both. This means that each unit 100 can have the capability of being modified through a download from a computer network even if a unit 100 was provided with a weighted token priority at build-time in a manufacturing center. Alternatively, or in addition to these ways, the token priority of a unit 100 based on its environmental factors can be computed locally in each air conditioner 100 with a pre-stored algorithm.

In Step 325, each of the air conditioners 100 can record the status of the first token assigned in the logical token ring 200. Next, in Step 330, the first air conditioner 100 such as the air conditioner 100A as illustrated in FIG. 2B which has the first token 502A can determine the priority or order in which the token or set of tokens should be passed from one unitary air conditioner 100 to the next. Once this order of priority list is established with the first unitary air conditioner 100A, the token 502 can be passed to the appropriate unitary air conditioner 100 with highest priority as illustrated by step 335 in FIG. 3.

In Step 340, power of the unitary air conditioner 100 with the highest priority can be initiated. In this step, a communications signal can be sent to a communications transceiver 107 of the unitary air conditioner so that the communications transceiver 107 or programmable logic 125 can control the relay 165A to the compressor 115. Alternatively, if the token ring list is stored in memory 105 of the unitary air conditioner 100, then the programmable logic 125 can activate the compressor 120 by activating the relays 165. In routine 345, the unitary air conditioner 100A with the token 502 can monitor the status of other token ring members as well as other variables such as internal and external temperature changes.

Next, in decision Step 350, it is determined whether the unitary air conditioner 100 with the token 502 has completed its cooling cycle to a desired temperature. If the inquiry to decision Step 350 is negative, then the "no" branch is followed back up to routine 345. If the inquiry to decision Step 350 is positive, then the "yes" branch is followed to Step 355.

In Step 355, the token 502 can be passed to the unitary air conditioner 100 with the next highest priority in the token ring list. In decision Step 360, it is determined if all unitary air conditioners 100 who are members of a particular logical token ring network 200 have reached their desired temperatures.

If the inquiry to decision Step 360 is negative, then the "no" branch is followed back to Step 340 in which powering of the air conditioner 100 with the next highest priority is initiated. If the inquiry to decision Step 360 is positive, then the "yes" branch is followed and the process can then can end. As noted above, one of ordinary skill in the art recognizes that multiple tokens 502 can be distributed in any given logical token ring network 200.

Figure 4:
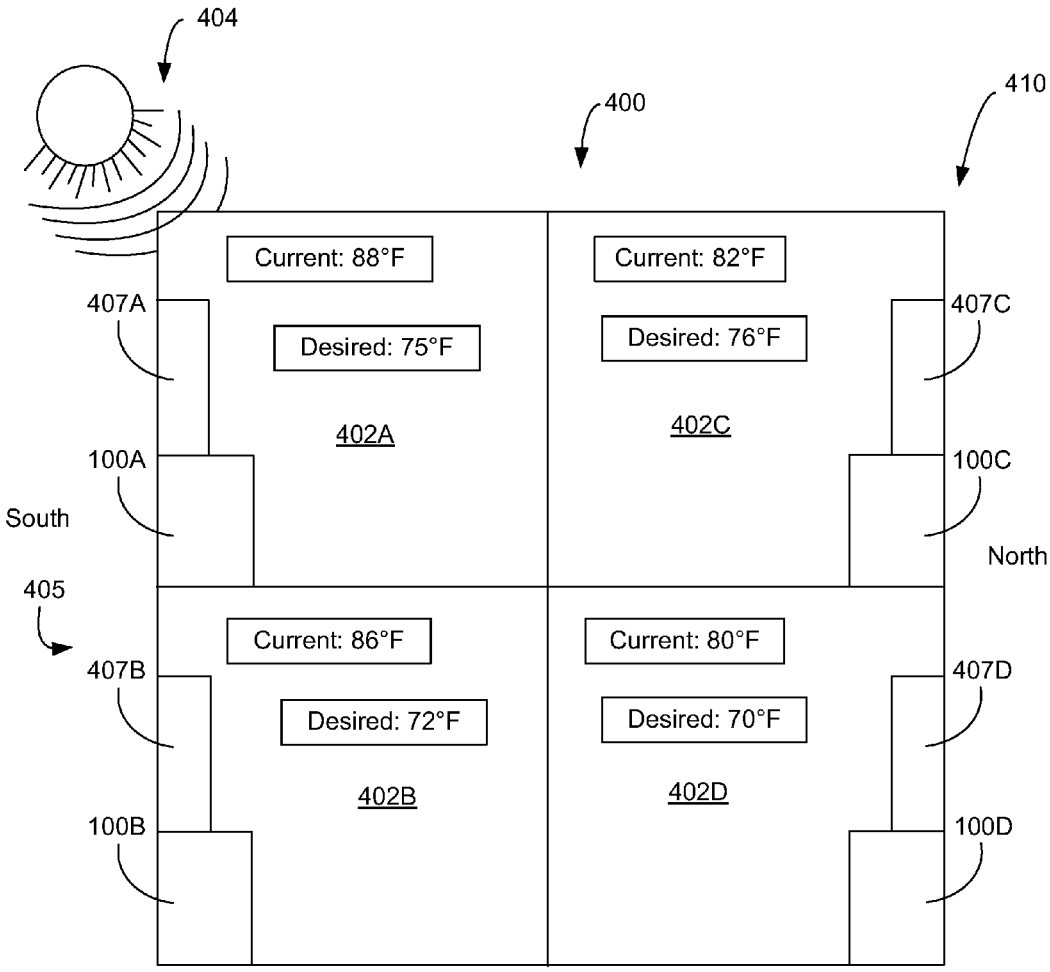
FIG. 4 is a diagram illustrating exemplary different cooling loads of a multiunit building which may be caused by external environmental elements such as sunlight according to one exemplary embodiment of the invention.

Referring now to FIG. 4 is a diagram illustrating exemplary different cooling loads of a multiunit building 400 which may be caused by external environmental elements such as sunlight 404 according to one exemplary embodiment of the invention. A first living space 402A may have a current temperature of eighty-eight degrees Fahrenheit and a desired temperature setting of seventy-five degrees Fahrenheit. The desired temperature setting may be the temperature set by the occupant on the thermostat 150. The current temperature may be displayed by the thermometer which can be part of the thermostat 150. The first living space can have a first window 407A and a first unitary air conditioner 100A.

Similarly, a second living space 402B may have a current temperature of eighty-six degrees Fahrenheit and a desired temperature setting of seventy-two degrees Fahrenheit. The second living space can have a second window 407B and a secondary unitary air conditioner 1008.

The third living space 402C may have a current temperature of eighty-two degrees Fahrenheit and a desired temperature setting of seventy-six degrees Fahrenheit. The third living space 402C can have a third window 407C and a third unitary air conditioner 1008.

The fourth living space 402D may have a current temperature of eighty degrees Fahrenheit and a desired temperature setting of seventy degrees Fahrenheit. The fourth living space 402D can have a fourth window 407D and a four unitary air conditioner 100D.

The first and second living spaces 402A, 402B may comprise units which face the south direction in the northern hemisphere. This means that that these two units may receive a significant amount of sunlight 404 during the day which can increase the cooling load for these two spaces 402A, 402B. Meanwhile, the third and fourth living spaces 402C and 402D may face a north direction in the northern hemisphere. This means that these two units, compared to the first two units, may receive a reduced amount of sunlight 404 due to shading from the building or multiunit structure 400.

One of ordinary skill in the art recognizes that other current temperatures and desired temperatures, higher or lower than those discussed and illustrated, are not beyond the scope of this inventive system. Further, other temperature units besides Fahrenheit, such as the Celsius scale, can be used without departing from the invention. Also, any number of units 402 could be part of the multiunit structure 400 such as on the order of one hundred units 402 or two hundred units 402 like in apartments or hotels without departing from the invention.

FIG. 5 is a logic flow diagram illustrating an exemplary method 500 for controlling unitary air conditioners 100 in a multiunit building 400 by assigning each unitary air conditioner 100 to predetermined groups based on environmental factors which may impact cooling loads according to one exemplary embodiment of the invention. Step 505 is the first step in the process or method 500 in which units 402 that are significantly impacted by environmental factors (like sunlight 404) are identified. In the exemplary embodiment illustrated in FIG. 4, this means that the first and second units 402A and 402B would be identified as units which are significantly impacted by sunlight 404.

Next, in step 510, these two units 402A, 402B would be assigned to a first group of units 402. In step 515, those units 402 which are not impacted by environmental factors, like sunlight, would be identified. For the exemplary embodiment illustrated in Figure, the third and fourth units 402C, 402D would be identified. Then, in step 520, these third and fourth units 402C, 402D which are not impacted by environmental factors would be assigned to a second group.

Next, in routine 520, the air conditioners 100 of the first group would be activated according to a predetermined sequence, such as according to the token algorithm 300 of FIG. 3. Subsequently or in parallel with routine 520, in routine 530, air conditioners 100 of the second low environmental impact group would be activated according to a predetermined sequence, such as according to the token algorithm 300 of FIG. 3. Then in optional routine 535, if the external environmental factors have diminished, then both groups can be combined and the air conditioners 100 of both groups may be activated according to a predetermined sequence, such as by the token algorithm 300 of FIG. 3.

Alternative embodiments of algorithms for controlling the unitary air conditioners 100 will become apparent to one of ordinary skill in the art to which the invention pertains without departing from its spirit and scope. Thus, although this invention has been described in exemplary form with a certain degree of particularity, it should be understood that the present disclosure is made only by way of example and that numerous changes in the details of construction and the combination and arrangement of parts or steps may be resorted to without departing from the scope or spirit of the invention. Accordingly, the scope of the present invention may be defined by the appended claims rather than the foregoing description.

What is claimed is:

1. A method for reducing a load on an electric grid, comprising:

coupling one or more unitary air conditioners to a distribution transformer;

controlling downloading of energy from the one or more unitary air conditioners with electronic intelligence which is distributed across the one or more unitary air conditioners so that a load on the distribution transformer is substantially reduced, the electronic intelligence comprising a token ring network for the one or more unitary air conditioners in which each unitary air conditioner receiving a token is permitted to power its compressor among the one or more unitary air conditioner members of the token ring network while each unitary air conditioner without a token is not permitted to power its compressor.

2. The method of claim 1, further comprising establishing a token ring network among the one or more unitary air conditioners.

3. The method of claim 1, further comprising assigning a token to a first unitary air conditioner according to predetermined criteria.

4. The method of claim 3, wherein the predetermined criteria comprises assessing a serial number assigned at manufacture for a unitary air conditioner.

5. The method of claim 1, further comprising storing a token ring list in memory of each unitary air conditioner.

6. The method of claim 1, further comprising passing one or more tokens among the unitary air conditioners.

7. The method of claim 1, wherein each unitary air conditioner comprises a compressor and an exterior fan.

8. The method of claim 7, further comprising transmitting control signals from a remote location for deactivating a compressor and exterior fan of at least one unitary air conditioner while allowing an interior blower of a respective unitary air conditioner to continue circulating air.

9. The method of claim 8, wherein the control signals are sent according to a power lines communication protocol.

10. The method of claim 8, wherein the control signals are sent according to a wireless communication protocol.

11. The method of claim 1, further comprising identifying one or more unitary air conditioners that are significantly impacted by external environmental factors and assigning token priority to compensate for these environmental factors.

12. The method of claim 11, further comprising loading the token priority to compensate for the environmental factors into each unitary air conditioner at a time of installation of a respective unitary air conditioner within a building.

13. The method of claim 11, further comprising downloading the token priority over a communications network.

14. A method for reducing a load on an electric grid, said comprising:

controlling downloading of energy from one or more unitary air conditioners with electronic intelligence which is distributed across the one or more unitary air conditioners, the electronic intelligence comprising a token ring network for the one or more unitary air conditioners in which each unitary air conditioner receiving a token is permitted to power its compressor among the one or more unitary air conditioner members of the token ring network while each unitary air conditioner without a token is not permitted to power its compressor.

15. The method of claim 14, wherein each air conditioner comprises a unitary air conditioner having an exterior fan for cooling the compressor and a blower for circulating conditioned air.

16. The method of claim 15, further comprising coupling the one or more unitary air conditioners to a distribution transformer.

17. The method of claim 16, further comprising assigning a token to a first unitary air conditioner according to predetermined criteria.

18. The method of claim 17, wherein the predetermined criteria comprises assessing a serial number assigned at manufacture for a unitary air conditioner.

19. The method of claim 18, further comprising storing a token ring list in memory of each unitary air conditioner.

20. The method of claim 19, further comprising identifying one or more unitary air conditioners that are significantly impacted by external environmental factors and assigning token priority to compensate for these environmental factors.

* * * * *